US006044532A

United States Patent [19]

Bowling et al.

[11] Patent Number: 6,044,532

[45] Date of Patent: Apr. 4, 2000

[54] COMBINATION CREMATION URN DISPLAY PEDESTAL AND CREMATION REMAINS CONTAINER

[75] Inventors: Donald W. Bowling, Osgood; John R. Enneking; John J. Greiwe, both of Batesville; Daniel J. Parker, Connersville, all of Ind.; Mark H. Thesken, Cincinnati, Ohio

[73] Assignee: Batesville Services, Inc., Batesville, Ind.

[21] Appl. No.: 09/165,815

[22] Filed: Oct. 2, 1998

[51] Int. Cl.[7] ..... A61G 17/00

[52] U.S. Cl. ..... 27/1; 108/150; 108/139; 248/349.1

[58] Field of Search ..... 27/1; 108/150, 108/139, 20, 23; 248/349.1, 131, 415; 362/133, 134, 127

[56] References Cited

U.S. PATENT DOCUMENTS

| | | | |
|---|---|---|---|
| D. 304,641 | 11/1989 | Bourassa . | |
| D. 327,765 | 7/1992 | Roberts et al. . | |
| 1,971,391 | 8/1934 | Bilton . | |
| 2,600,770 | 6/1952 | Hofacer . | |
| 2,754,409 | 7/1956 | Zutler . | |
| 3,142,521 | 7/1964 | Petroff . | |
| 4,026,067 | 5/1977 | Wengel | 248/131 X |
| 4,324,026 | 4/1982 | Craft . | |
| 5,171,060 | 12/1992 | Kaye | 108/23 X |
| 5,421,271 | 6/1995 | Sui | 108/20 X |
| 5,709,441 | 1/1998 | Bartling et al. . | |
| 5,749,304 | 5/1998 | Turner | 108/20 |
| 5,765,796 | 6/1998 | Lanus | 248/349.1 |
| 5,816,171 | 10/1998 | Fitts, Jr. | 108/23 |

*Primary Examiner*—Brian K. Green
*Assistant Examiner*—William L. Miller
*Attorney, Agent, or Firm*—Wood, Herron & Evans, L.L.P.

[57] ABSTRACT

A combination cremation urn display pedestal and cremation remains container comprises a decorative upstanding support, a turntable assembly mounted at an upper end of the support adapted to rotatably display a cremation urn thereon, and an openable and closable compartment adapted to contain cremation remains therein forming a part of the support. In a second aspect, a combination cremation urn display pedestal and cremation remains container comprises a decorative upstanding support adapted to display a cremation urn thereon, a light source within the support adapted to illuminate the cremation urn on the support, and an openable and closable compartment adapted to contain cremation remains therein forming a part of the support. In a third aspect, a combination cremation urn display pedestal and cremation remains container comprises a decorative upstanding support, a motor driven turntable assembly mounted at an upper end of the support adapted to rotatably display a cremation urn thereon, a light source within the support adapted to illuminate the cremation urn on the turntable and an openable and closable compartment adapted to contain cremation remains therein forming a part of the support.

25 Claims, 3 Drawing Sheets

COMBINATION CREMATION URN DISPLAY PEDESTAL AND CREMATION REMAINS CONTAINER

FIELD OF THE INVENTION

This invention relates generally to funeral products, and more particularly to cremation remains storage and cremation urn display pedestals.

BACKGROUND OF THE INVENTION

Cremation is a growing segment of the funeral industry. Consequently, there is an increasing demand for more and higher quality styles and designs of cremation urns.

One popular design for cremation urns is the outdoor/animal scene theme. Four such designs are disclosed in U.S. Pat. Nos. Des. 356,421, 370,767, 370,766 and 370,768, all of which are assigned to the assignee of the present invention and hereby incorporated by reference herein as if fully set forth in their entirety.

Such cremation urn designs may include rather delicate features and the like which could be subject to damage and/or breakage during handling thereof. It would therefore be desirable to provide a means of protecting such delicate features of a cremation urn yet without obstructing the view thereof.

Further, in the case of U.S. Pat. Nos. Des. 356,421 and 370,767, which include dolphins suspended above rock and/or coral as if swimming in water, it would be desirable to more closely simulate the water in which the dolphins or other aquatic animals are swimming.

As a solution to this problem, a cremation urn of the type disclosed in U.S. patent application Ser. No. 08/733,882 and U.S. Design patent application Ser. No. 29/078,073 was devised. Both of these applications are assigned to the assignee of the present invention and are hereby incorporated by reference herein as if fully set forth in their entirety.

In these applications, an acrylic cremation urn is disclosed including first and second masses. The second mass is contained within the first mass. The second mass includes an opening and a cavity within the second mass for receiving cremated remains. At least a portion of the first mass is transparent so as to permit viewing of at least a portion of the second mass through the transparent portion of the first mass. A cover is closable over the opening to retain the cremated remains within the cavity.

In a preferred form of this cremation urn, the second mass is opaque and may include a decorative configuration and/or surface ornamentation which is viewable through the transparent portion of the first mass. The second mass may take one of many decorative forms, for example, an aquatic form such as that of a submerged land mass or corral mass. The second mass may further include swimming aquatic animals suspended thereover, for example, dolphins. The first mass may further preferably include a textured surface which is translucent and at least one transparent window through which the portion of the second mass is viewable. In a preferred form, the second mass may include a front window, a back window, a pair of side windows and at least one top window in which the portion of the second mass may be viewed.

As will be appreciated upon reviewing the disclosures of these two applications, the combination of the first transparent or translucent mass and the second opaque mass results in a much smaller cavity or volume available within the cremation urn for receiving cremation remains of a deceased. In fact, only a portion of the cremated remains of a deceased can ordinarily be contained in such a cremation urn due to that small cavity or volume (and otherwise due to restricting the overall size of the cremation urn to a managable size). The interior volume of the urn of Application Serial Nos. 08/733,882 and 29/078,073 is approximately 10–15 cubic inches, whereas an average sized deceased yields approximately 200 cubic inches of cremation remains.

The growing cremation segment of the funeral industry has also driven the demand for cremation urns which closely resemble and in fact are themselves fine art sculptures. A popular construction material for fine art sculptures is acrylic. One such fine art acrylic cremation urn sculpture is disclosed in U.S. Design patent application Ser. No. 29/077,523, assigned to the assignee of the present invention and hereby incorporated by reference herein as if fully set forth in its entirety. The transparent acrylic provides a number of ornamentally attractive qualities, in that one can see through the transparent portion to an inner, decorative opaque portion of the sculpture, and impressions or designs may be incorporated into the exterior surfaces of the transparent acrylic which are viewable at any point around a 360° viewing area of the sculpture. As will be appreciated upon reviewing the disclosure of this application, the transparent portion of the urn is by far the majority of the mass of the urn; to maintain the cremation urn at a manageable size, the cavity or volume within the opaque portion of the urn available for storage of cremation remains is too small to store the entire remains of a deceased therein. The interior volume of the larger urn of application Ser. No. 29/077,523 is approximately 30–40 cubic inches.

Sculptures have for some time been displayed in various ways. One method of displaying fine art sculptures involves the use of a display pedestal upon which the sculpture is perched. Such prior art sculpture display pedestals may include a turntable mounted at an upper end thereof upon which the sculpture is supported, which turntable is rotated by an electric motor to facilitate viewing of the sculpture as it rotates. Such prior art display pedestals are also known to include a light source therein for illuminating the sculpture, and in particular for illuminating transparent sculptures fabricated of, for example, acrylic.

Therefore, there is a need for an attractive cremation urn display pedestal which includes the ability for storing the excess amount of cremation remains of a deceased which is not able to fit within a cremation urn of limited volume, and preferably which stores the excess remains in close proximity to, or in association with, the displayed cremation urn.

SUMMARY OF THE INVENTION

As a solution to the need described above, and in one broad aspect, the present invention is a combination cremation urn display pedestal and cremation remains container. It comprises a decorative upstanding support, a turntable assembly mounted at an upper end of the support adapted to rotatably display a cremation urn thereon, and an openable and closable compartment adapted to contain cremation remains therein forming a part of the support.

In a second broad aspect, a combination cremation urn display pedestal and cremation remains container comprises a decorative upstanding support adapted to display a cremation urn thereon, a light source within the support adapted to illuminate the cremation urn on the support, and an openable and closable compartment adapted to contain cremation remains therein forming a part of the support.

In a third broad aspect, a combination cremation urn display pedestal and cremation remains container comprises a decorative upstanding support, a motor driven turntable assembly mounted at an upper end of the support adapted to rotatably display a cremation urn thereon, a light source within the support adapted to illuminate the cremation urn on the turntable and an openable and closable compartment adapted to contain cremation remains therein forming a part of the support.

As for each of these three embodiments of the invention, in the event that the displayed cremation urn has only a limited volume such that it is capable of containing only a portion of the cremated remains of a deceased, the balance of the cremated remains of the deceased can be stored in the compartment of the support.

The invention may advantageously include various additional features. For example, the display pedestal includes a lazy susan including a first portion secured relative to the support and an second portion rotatable relative to the first portion. The turntable assembly is secured relative to the rotatable portion of the lazy susan. The first portion of the lazy susan is secured to a plate mounted within the support. The turntable assembly comprises a base secured relative to the second portion of the lazy susan, standoffs mounted to the base and top mounted to the standoffs. The support includes an opening in the upper end thereof, the standoffs pass through the opening and the top covers the opening. The second portion of the lazy susan has mounted thereon a driven pulley. The turntable assembly is mounted on the driven pulley. A motor is mounted to the plate and includes a driving pulley, and a drive belt encircles the driving and driven pulleys.

The support includes a transparent portion at an upper end through which light passes from the light source to illuminate the displayed cremation urn. The light source is mounted centrally within the support on the plate mounted within the support. The transparent portion is a transparent lens mounted centrally on the top of the turntable assembly.

The display pedestal includes a switch and associated electrical circuitry for selectively energizing the motor and light source to select an operating mode for the display pedestal. The operating modes for the display pedestal are: 1) motor and light source off, 2) motor on and light source off, 3) motor off and light source on, and 4) motor and light source on.

The openable and closable compartment comprises a cover plate removably secured at a lower end of the support and encloses an interior volume of the support. In one embodiment of the compartment the cover plate includes a down-turned U-shaped open-ended structure mounted on an interior side of the cover plate and adapted to receive therein a cremation remains containing chest. In another embodiment of the compartment the interior volume of the support is divided into two sub-volumes via a divider panel mounted in the support. One of the sub-volumes is adapted to receive therein a cremation remains containing chest and the other of the two sub-volumes houses apparatus associated with the turntable assembly and/or light source.

The invention thus provides the advantages of providing a decorative display pedestal including multiple operating mocies for rotating and illuminating a cremation urn, for example, a fine art transparent acrylic cremation urn, while also combining storage for storing the excess cremated remains of a deceased which is not able to be stored in such a cremation urn.

These and other advantages of the present invention will become more readily apparent during the following detailed description taken in conjunction with the drawings herein, in which:

DETAILED DESCRIPTION OF THE INVENTION

Figure 1:
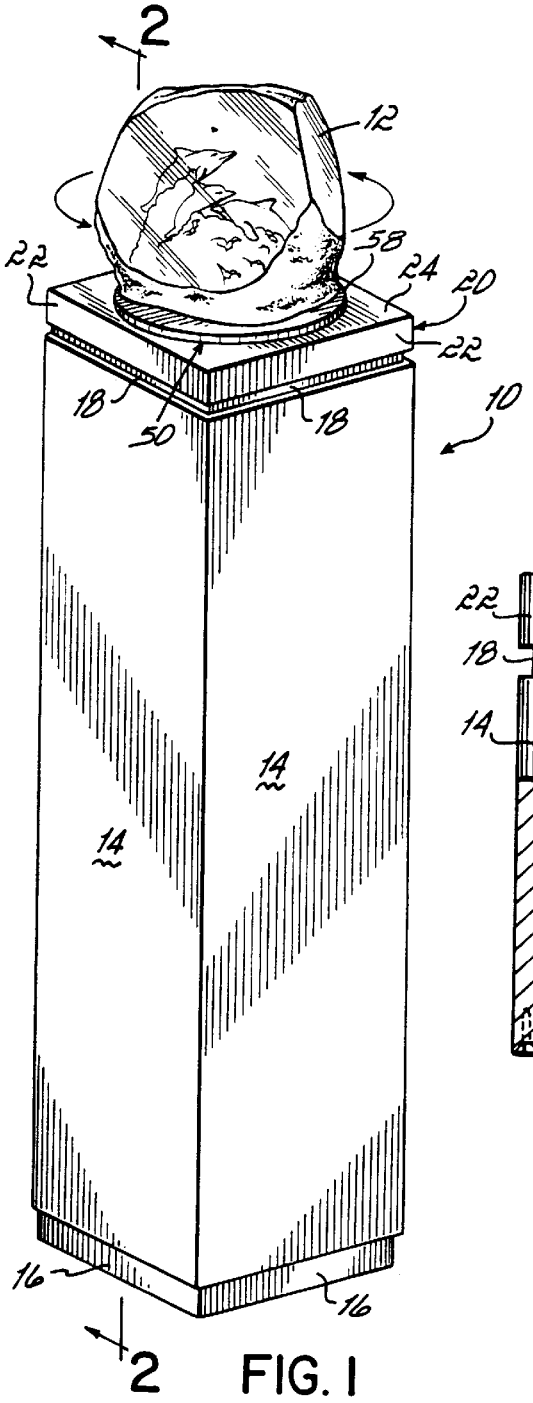
FIG. 1 is a perspective view of one embodiment of the combination cremation urn display pedestal and cremation remains container of the present invention.

Referring first to FIG. 1, there is illustrated a combination cremation urn display pedestal and cremation remains container 10 according to the present invention. Illustrated as being displayed on top of pedestal 10 is an acrylic cremation urn 12 of the type disclosed in U.S. patent application Ser. No. 08/733,882 and U.S. Design patent application Ser. No. 29/078,073.

Referring now to FIGS. 1–4, the display pedestal 10 includes four equally dimensioned walls 14, a recessed lower decorative feature comprised of four equally dimensioned walls 16, a recessed upper decorative feature comprised of four equally dimensioned walls 18 and a top portion 20 including four equally dimensioned walls 22 attached to a top wall 24 including a circular opening 26 therein. All of the walls forming the pedestal 10 are preferably and advantageously fabricated with pressed wood including on one side thereof a decorative vinyl sheet or cladding laminated thereto. To fabricate, for example, the four walls 14 of the pedestal 10, a length of such vinyl cladded pressed wood equal to four times the width of a single wall 14 is provided, and three equally spaced apart 90° V-shaped notches are cut into the pressed wood leaving a living hinge formed of the vinyl cladding at those locations. The walls 14 are simply folded at the living hinges of the vinyl cladding to form the four-sided enclosure; the abutting edges of the pressed wood are beveled and may be glued together or fastened with fasteners such as dowels, screws or the like.

An internal platform 30 likewise fabricated of pressed wood and in the form of a circumferential rib is positioned within groove 32 in the walls 14. Groove 32 is formed in the walls 14 at the same time the above-described V-shaped notches are cut. Platform 30 is placed in groove 32 as walls 14 are wrapped around platform 30. This platform or rib 30 is utilized as a mounting platform to which is mounted a plate 34. Plate 34 has a firs portion 35 of a lazy susan bearing 36 affixed to plate 34. A second portion 38 of the lazy susan 36 is rotatable relative to the first, fixed portion 35. A driven pulley 40 is mounted to the rotating portion 38 of the lazy susan 36. An electric motor 42 is mounted to the underneath side of plate 34 and includes an output shaft 44 which drives a driving pulley 46. A belt 48 encircles the driving 46 and driven 40 pulleys. This assembly may further include a so-called idler pulley 49 (shown only in FIG. 3 for clarity) for adjusting the tension of belt 48.

A turntable assembly 50 includes a bottom or base 52 secured to driven pulley 40 as by dowels 54. Standoffs 56 are secured to base or bottom 52. Turntable top 58 is secured to the upper ends of standoffs 56. Turntable top 58 includes a circular opening 60 therethrough including a countersink 62 which accepts a transparent lens 64. The transparent lens 64, preferably fabricated of acrylic, allows light to pass out of the pedestal 10 from a light source, for example, a light 66 mounted to and centrally of plate 34.

Electrical cord 70 connects motor 42 and light 66 to an appropriate electrical source, for example, household 110 volt a/c. A switch 72 and associated circuitry provides selective operation of the display pedestal 10 in one of four operating modes. In the first mode the motor 42 and light 66 are both off. In the second mode the motor 42 is on and the light 66 is off. In the third mode the motor 42 is off and the light 66 is on. In the fourth mode the motor 42 and light 66 are both on. Thus, the user has the option of running the turntable alone, running the light alone or running the turntable and light together.

Figure 4:
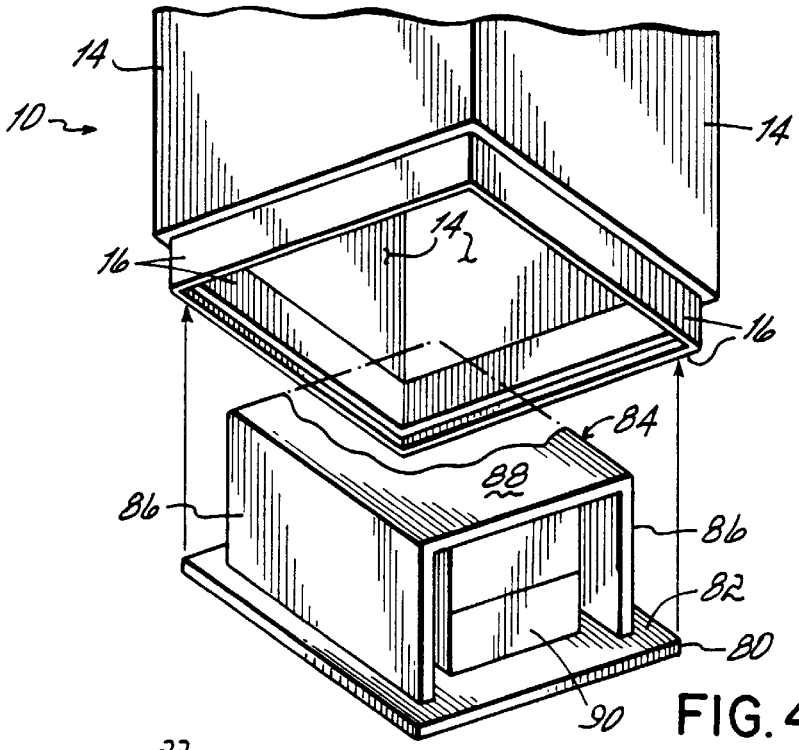
FIG. 4 illustrates the supplemental cremation remains containing compartment of FIGS. 1–3.
Figure 3:
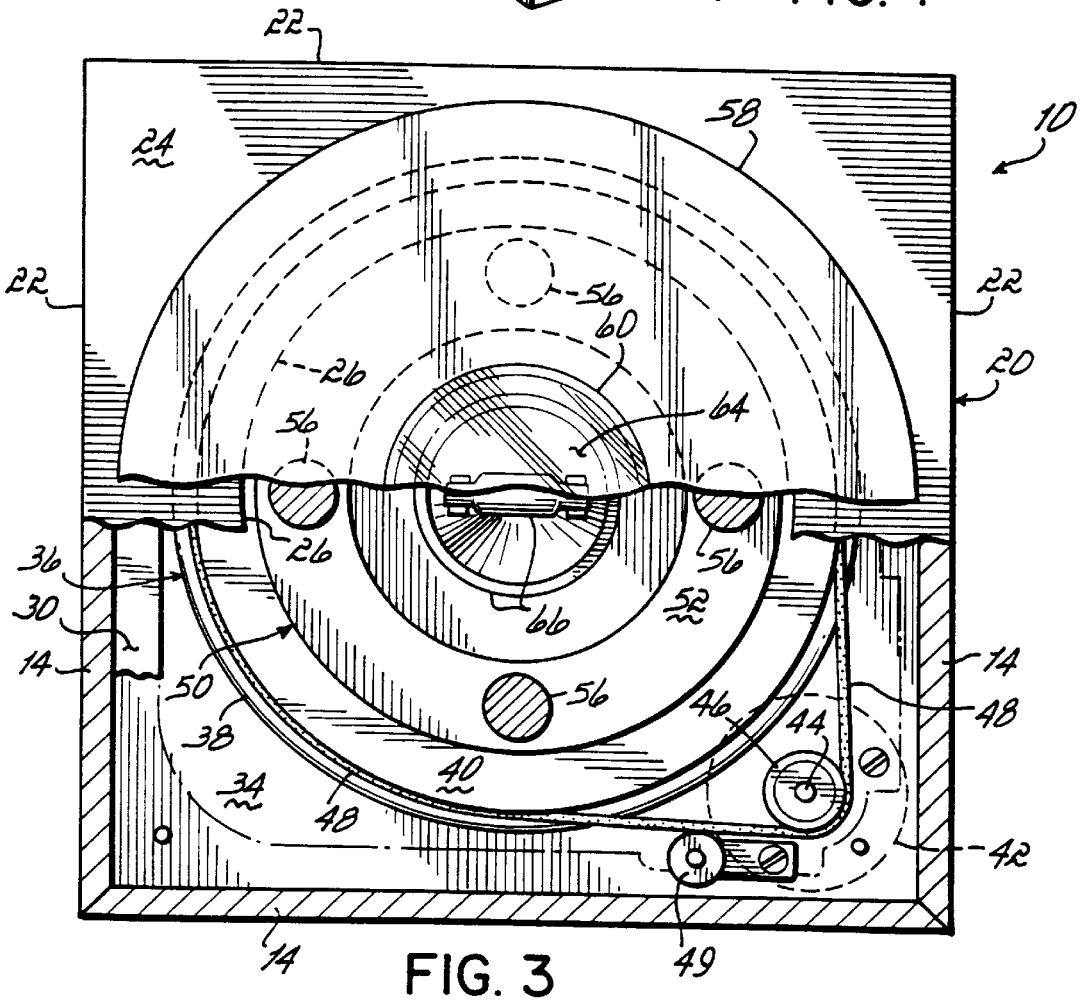
FIG. 3 is a top view partially broken away of the display pedestal of FIGS. 1 and 2.

Referring now to FIG. 4, one embodiment of the supplemental cremation remains compartment of the invention is illustrated. In this embodiment, a cover plate 80 is removably secured to the walls 16 as by screws or the like. The cover plate 80 has mounted on an interior surface 82 thereof a down-turned U-shaped open-ended pressed wood structure 84 which includes side walls 86 and a top wall 88. The structure 84 is sized to receive therein a cremation remains chest 90 of the type marketed by the assignee of the invention as Bronze Chest, which is approximately 4⅝ inches by 8⅞ inches by 5⅞ inches (yielding 205 cubic inches of storage volume).

Figure 5:
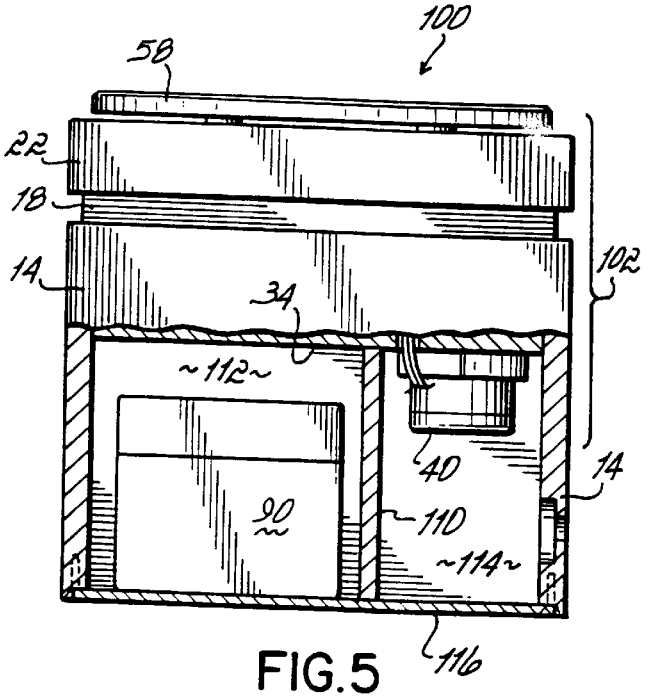
FIG. 5 illustrates an alternative embodiment of the invention in that it is a substantially shorter tabletop model including a somewhat modified supplemental cremation remains containing compartment.
Figure 2:
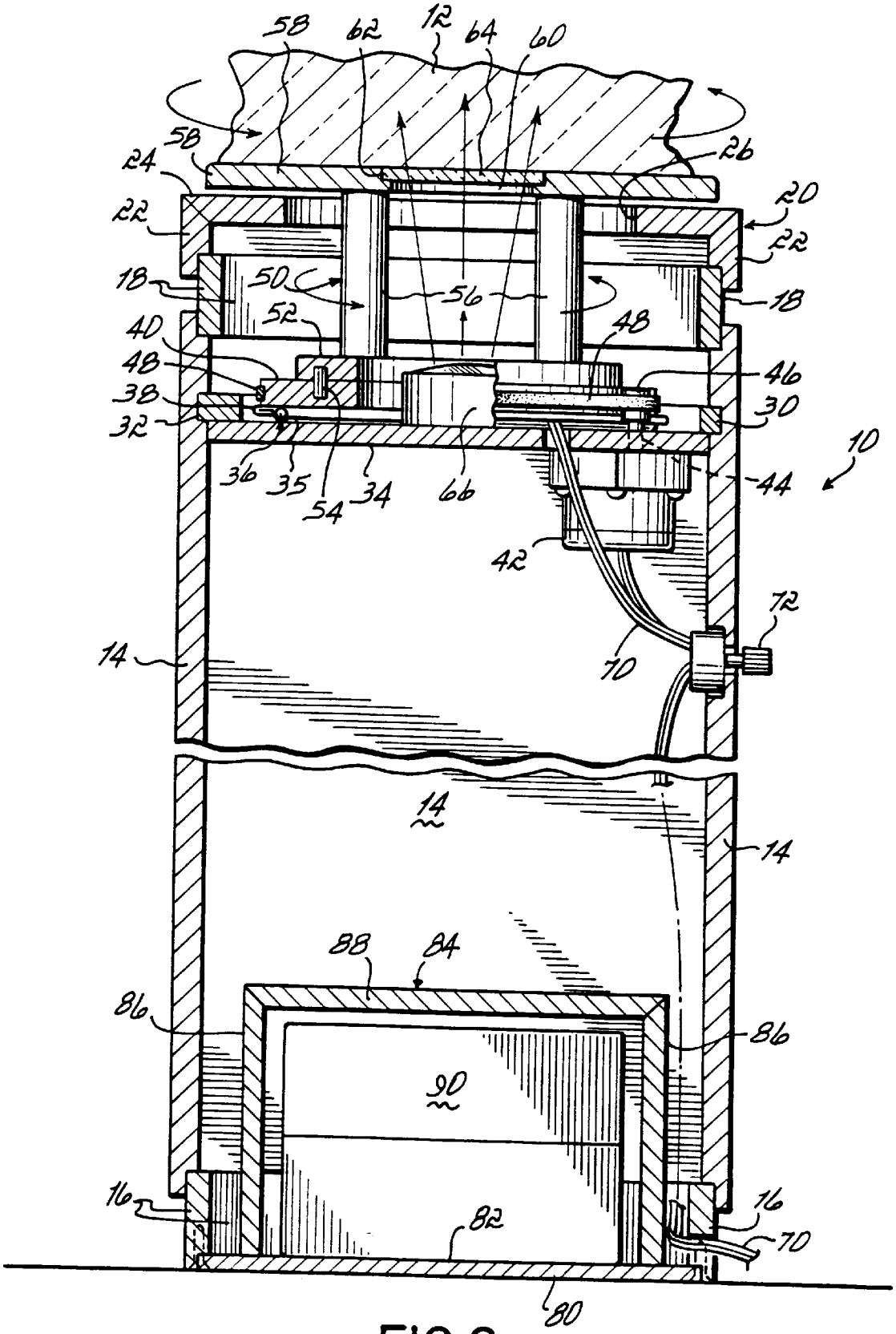
FIG. 2 is a cross-sectional view taken along line 2—2 of FIG. 1 and illustrating the interior of the display pedestal housing the motor driven turntable assembly, light source and supplemental cremation remains compartment.

Referring now to FIG. 5, there is illustrated an alternative embodiment of the present invention. Whereas the pedestal 10 shown in FIG. 1 is approximately 47.625 inches tall (excluding turntable top 58), the alternative embodiment 100 shown in FIG. 5 is only approximately 11.25 inches tall (also excluding turntable top 58). Thus, the embodiment in FIG. 5 readily lends itself to display on a tabletop or the like. The turntable assembly, light source and otherwise the entire upper portion 102 of the alternative embodiment 100 of this invention is identical to that shown in FIGS. 1–4 and described above. However, in the alternative embodiment illustrated in FIG. 5, a divider wall 110 divides the interior volume of the pedestal 100 into two sub-volumes 112 and 114. Sub-volume 112 is sized to receive the aforementioned chest 90. Sub-volume 114 houses apparatus associated with the turntable motor 42 and/or lamp 66. A removable cover plate 116 removably secures the chest 90 within the volume 112 and is removably attached to the walls 14 as by screws or the like.

The preferable height of the walls 14 of the display embodiment of FIG. 1 is approximately 43.75 inches, whereas the preferable height of that of the embodiment of FIG. 5 is approximately 9.25 inches. Upper walls 16 add an additional 0.75 inches to the height of both embodiments. And, top 20 adds an additional 1.25 inches to the height of both embodiments. Lower walls 18 add an additional 1.875 inches to the height of the FIG. 1 embodiment. In addition, both embodiments are approximately 12 inches on a side. The pressed wood forming the walls 14, 16, 18, 22 and 24 is preferably approximately 0.625 inches thick. The lazy susan 36 may preferably be of the type available as part no. 124300/21A from Woodcraft of Parkersburg, W.Va. The motor 42 may preferably be a model PA, 10 RPM, 115 Volt, 60 Hz, 7.5 Watts available as part no. 6A177 from Grainger, Indianapolis, Ind. and manufactured by Hurst Manufacturing Division of Emerson Electric Company, Princeton, Ind. The light 66 may preferably be a 20 Watt, 12 Volt, type T available from Hera Lighting L.P., Norcross, Ga., and may be used in combination with a transformer which is preferably a E60T AC adapter 120V–11.5V out, available from Hera Lighting L.P., Norcross, Ga. The switch 66 may preferably be a 2 circuit -4 position rotary switch rated 3A-125V, 1A-250V, manufactured by Leviton and available from Kirby Risk Electrical Supply, Columbus, Ind.

Those skilled in the art will readily recognize numerous adaptations and modifications which can be made to the present invention which will result in an improved cremation urn display pedestal and cremation remains container, yet all of which will fall within the spirit and scope of the present invention as defined in the following claims. For example, the supplemental cremation remains compartment could be used for memorabilia instead of or in combination with cremation remains. Accordingly, the invention is to be limited only by the scope of the following claims and their equivalents.

What is claimed is:

1. A combination cremation urn display pedestal and cremation remains container comprising:

a decorative upstanding support;

a turntable assembly mounted at an upper end of said support adapted to rotatable display a cremation urn thereon;

an openable and closable compartment adapted to contain cremation remains therein forming a part of said support;

whereby in the event that the displayed cremation urn has only a limited volume such that it is capable of containing only a portion of the cremated remains of a deceased, the balance of the cremated remains of the deceased can be stored in said support compartment;

a lazy susan including a first portion secured relative to said support and a second portion rotatable relative to said first portion;

said turntable assembly being secured relative to said rotatable portion of said lazy susan; and wherein said first portion of said lazy susan is secured to a plate mounted within said support.

2. The combination of claim 1 wherein said turntable assembly comprises:

a base secured relative to said second portion of said lazy susan;

standoffs mounted to said base; and a top mounted to said standoffs.

3. The combination of claim 2 wherein said support includes an opening in said support upper end, said standoffs passing through said opening and said top covering said opening.

4. The combination of claim 2 wherein said second portion of said lazy susan has mounted thereon a driven pulley, said turntable assembly bottom being mounted on said driven pulley.

5. The combination of claim 4 further including a motor mounted to said plate and including a driving pulley, and a drive belt encircling said driving and driven pulleys.

6. A combination cremation urn display pedestal and cremation remains container comprising:

a decorative upstanding support adapted to display a cremation urn thereon;

a light source within said support adapted to illuminate the cremation urn on said support;

an openable and closable compartment adapted to contain cremation remains therein forming a part of said support;

whereby in the event that the displayed cremation urn has only a limited volume such that it is capable of containing only a portion of the cremated remains of a deceased, the balance of the cremated remains of the deceased can be stored in said support compartment;

wherein said support includes a transparent portion at an upper end through which light passes from said light source to illuminate the displayed cremation urn;

wherein said light source is mounted centrally within said support on a plate mounted within said support;

further including a turntable assembly mounted at an upper end of said support adapted to rotatable display the cremation urn thereon; and further including a lazy susan including a first portion secured to said plate and a second portion rotatable relative to said first portion;

said turntable assembly being secured relative to said rotatable portion of said lazy susan.

7. The combination of claim 6 wherein said turntable assembly comprises:

a base secured relative to said second portion of said lazy susan;

standoffs mounted to said base; and a top mounted to said standoffs.

8. The combination of claim 7 wherein said support includes an opening in said support upper end, said standoffs passing through said opening and said top covering said opening.

9. The combination of claim 7 wherein said second portion of said lazy susan has mounted thereon a driven pulley, said turntable assembly bottom being mounted on said driven pulley.

10. The combination of claim 9 further including a motor mounted to said plate and including a driving pulley, and a drive belt encircling said driving and driven pulleys.

11. The combination of claim 7 wherein said transparent portion is a transparent lens mounted centrally on said turntable assembly top.

12. A combination cremation urn display pedestal and cremation remains container comprising:

a decorative upstanding support;

a turntable assembly mounted at an upper end of said support adapted to rotatably display a cremation urn thereon;

an openable and closable compartment adapted to contain cremation remains therein forming a part of said support;

whereby in the event that the displayed cremation urn has only a limited volume such that it is capable of containing only a portion of the cremated remains of a deceased, the balance of the cremated remains of the deceased can be stored in said support compartment;

wherein said openable and closable compartment comprises a cover plate removably secured at a lower end of said support enclosing an interior volume of said support; and wherein said cover plate includes a down-turned U-shaped open-ended structure mounted on an interior side of said cover plate and adapted to receive therein a cremation remains containing chest.

13. A combination cremation urn display pedestal and cremation remains container comprising:

a decorative upstanding support;

a turntable assembly mounted at an upper end of said support adapted to rotatable display a cremation urn thereon;

an openable and closable compartment adapted to contain cremation remains therein forming a part of said support;

whereby in the event that the displayed cremation urn has only a limited volume such that it is capable of containing only a portion of the cremated remains of a deceased, the balance of the cremated remains of the deceased can be stored in said support compartment;

wherein said openable and closable compartment comprises a cover plate removably secured at a lower end of said support enclosing an interior volume of said support; and wherein said interior volume of said support is divided into two sub-volumes via a divider panel mounted in said support, and wherein one of said sub-volumes is adapted to receive therein a cremation remains containing chest and the other of said sub-volumes houses apparatus associated with at least one of said turntable assembly and light source.

14. A combination cremation urn display pedestal and cremation remains container comprising:

a decorative upstanding support adapted to display a cremation urn thereon;

a light source within said support adapted to illuminate the cremation urn on said support; and an openable and closable compartment adapted to contain cremation remains therein forming a part of said support;

whereby in the event that the displayed cremation urn has only a limited volume such that it is capable of containing only a portion of the cremated remains of a deceased, the balance of the cremated remains of the deceased can be stored in said support compartment;

wherein said openable and closable compartment comprises a cover plate removably secured at a lower end of said support enclosing an interior volume of said, support; and wherein said cover plate includes a down-turned U-shaped open-ended structure mounted on an interior side of said cover plate and adapted to receive therein a cremation remains containing chest.

15. A combination cremation urn display pedestal and cremation remains container comprising:

a decorative upstanding support;

a motor driven turntable assembly mounted at an upper end of said support adapted to rotatably display a cremation urn thereon;

a light source within said support adapted to illuminate the cremation urn on said turntable;

an openable and closable compartment adapted to contain cremation remains therein forming a part of said support;

whereby in the event that the displayed crematicin urn has only a limited volume such that it is capable of containing only a portion of the cremated remains of a deceased, the balance of the cremated remains of the deceased can be stored in said support compartment;

wherein said openable and closable compartment comprises a cover plate removably secured at a lower end of said support enclosing an interior volume of said support;

wherein said cover plate includes a down-turned U-shaped open-ended structure mounted on an interior side of said cover plate and adapted to receive therein a cremation remains containing chest.

16. A combination cremation urn display pedestal and cremation remains container comprising:

a decorative upstanding support adapted to display a cremation urn thereon;

a light source within said support adapted to illuminate the cremation urn on said support; and an openable and closable compartment adapted to contain cremation remains therein forming a part of said support;

whereby in the event that the displayed cremation urn has only a limited volume such that it is capable of containing only a portion of the cremated remains of a deceased, the balance of the cremated remains of the deceased can be stored in said support compartment;

wherein said openable and closable compartment comprises a cover plate removably secured at a lower end of said support enclosing an interior volume of said support; and wherein said interior volume of said support is divided into two sub-volumes via a divider panel mounted in said support, and wherein one of said sub-volumes is adapted to receive therein a cremation remains containing chest and the other of said sub-volumes houses apparatus associated with at least one of said turntable assembly and light source.

17. A combination cremation urn display pedestal and cremation remains container comprising:

a decorative upstanding support;

a motor driven turntable assembly mounted at an upper end of said support adapted to rotatably display a cremation urn thereon;

a light source within said support adapted to illuminate the cremation urn on said turntable;

an openable and closable compartment adapted to contain cremation remains therein forming a part of said support;

whereby in the event that the displayed cremation urn has only a limited volume such that it is capable of containing only a portion of the cremated remains of a deceased, the balance of the cremated remains of the deceased can be stored in said support compartment;

wherein said openable and closable compartment comprises a cover plate removably secured at a lower end of said support enclosing an interior volume of said support; and wherein said interior volume of said support is divided into two sub-volumes via a divider panel mounted in said support, and wherein one of said sub-volumes is adapted to receive therein a cremation remains containing chest and the other of said sub-volumes houses apparatus associated with at least one of said turntable assembly and light source.

18. A combination display pedestal and cremation remains container comprising:

a decorative upstanding support;

a turntable assembly mounted at an upper end of said support adapted to rotably display a sculpture thereon;

an openable and closable compartment adapted to contain cremation remains therein forming a part of said support; and a lazy susan including a first portion secured relative to said support and a second portion rotatable relative to said first portion;

said turntable assembly being secured relative to said rotatable portion of said lazy susan;

said first portion of said lazy susan being secured to a plate mounted within said support.

19. A combination display pedestal and cremation remains container comprising:

a decorative upstanding support adapted to display a sculpture thereon;

a light source within said support adapted to illuminate the sculpture on said support; and an openable and closable compartment adapted to contain cremation remains therein forming a part of said support;

wherein said support includes a transparent portion at an upper end through which light passes from said light source to illuminate the displayed sculpture;

wherein said light source is mounted centrally within said support on a plate mounted within said support;

further including a turntable assembly mounted at an upper end of said support adapted to rotatably display the sculpture thereon;

further including a lazy susan including a first portion secured to said plate and a second portion rotatable relative to said first portion; and said turntable assembly being secured relative to said rotatable portion of said lazy susan.

20. A combination sculpture display pedestal and cremation remains container comprising:

a decorative upstanding support;

a turntable assembly mounted at an upper end of said support adapted to rotatably display a sculpture thereon; and an openable and closable compartment adapted to contain cremation remains therein forming a part of said support;

wherein said openable and closable compartment comprises a cover plate removably secured at a lower end of said support enclosing an interior volume of said support;

wherein said cover plate includes a down-turned U-shaped open-ended structure mounted on an interior side of said cover plate and adapted to receive therein a cremation remains containing chest.

21. A combination sculpture display pedestal and cremation remains container comprising:

a decorative upstanding support adapted to display a sculpture thereon;

a light source within said support adapted to illuminate the sculpture on said support; and an openable and closable compartment adapted to contain cremation remains therein forming a part of said support;

wherein said openable and closable compartment comprises a cover plate removably secured at a lower end of said support enclosing an interior volume of said support;

wherein said cover plate includes a down-turned U-shaped open-ended structure mounted on an interior side of said cover plate and adapted to receive therein a cremation remains containing chest.

22. A combination sculpture display pedestal and cremation remains container comprising:

a decorative upstanding support;

a motor driven turntable assembly mounted at an upper end of said support adapted to rotatably display a sculpture thereon;

a light source within said support adapted to illuminate the sculpture on said turntable; and an openable and closable compartment adapted to contain cremation remains therein forming a part of said support;

wherein said openable and closable compartment comprises a cover plate removably secured at a lower end of said support enclosing an interior volume of said support;

wherein said cover plate includes a down-turned U-shaped open-ended structure mounted on an interior side of said cover plate and adapted to receive therein a cremation remains containing chest.

23. A combination sculpture display pedestal and cremation remains container comprising:

a decorative upstanding support;

a turntable assembly mounted at an upper end of said support adapted to rotatably display a sculpture thereon; and an openable and closable compartment adapted to contain cremation remains therein forming a part of said support;

wherein said openable and closable compartment comprises a cover plate removably secured at a lower end of said support enclosing an interior volume of said support;

wherein said cover plate includes a down-turned U-shaped open-ended structure mounted on an interior side of said cover plate and adapted to receive therein a cremation remains containing chest; and wherein said interior volume of said support is divided into two sub-volumes via a divider panel mounted in said support, and wherein one of said sub-volumes is adapted to receive therein the cremation remains containing chest and the other of said sub-volumes houses apparatus associated with at least one of said turntable assembly and light source.

24. A combination sculpture display pedestal and cremation remains container comprising:

a decorative upstanding support adapted to display a sculpture thereon;

a light source within said support adapted to illuminate the sculpture on said support; and an openable and closable compartment adapted to contain cremation remains therein forming a part of said support;

wherein said openable and closable compartment comprises a cover plate removably secured at a lower end of said support enclosing an interior volume of said support;

wherein said cover plate includes a down-turned U-shaped open-ended structure mounted on an interior side of said cover plate and adapted to receive therein a cremation remains retaining chest; and wherein said interior volume of said support is divided into two sub-volumes via a divider panel mounted in said support, and wherein one of said sub-volumes is adapted to receive therein the cremation remains containing chest and the other of said sub-volumes houses apparatus associated with at least one of said turntable assembly and light source.

25. A combination sculpture display pedestal and cremation remains container comprising:

a decorative upstanding support;

a motor driven turntable assembly mounted at an upper end of said support adapted to rotatably display a sculpture thereon;

a light source within said support adapted to illuminate the sculpture on said turntable; and an openable and closable compartment adapted to contain cremation remains therein forming a part of said support;

wherein said openable and closable compartment comprises a cover plate removably secured at a lower end of said support enclosing an interior volume of said support;

wherein said cover plate includes a down-turned U-shaped open-ended structure mounted on an interior side of said cover plate and adapted to receive therein a cremation remains containing chest;

wherein said interior volume of said support is divided into two sub-volumes via a divider panel mounted in said support, and wherein one of said sub-volumes is adapted to receive therein the cremation remains containing chest and the other of said sub-volumes houses apparatus associated with at least one of said turntable assembly and light source.

* * * * *